United States Patent [19]

Breen

[11] Patent Number: 4,717,153

[45] Date of Patent: Jan. 5, 1988

[54] GOLF PRACTICE DEVICE

[76] Inventor: Joseph G. Breen, 575 Echo Glen Ave., River Vale, N.J. 07675

[21] Appl. No.: 880,672

[22] Filed: Jun. 30, 1986

[51] Int. Cl.[4] ..... A63B 69/36

[52] U.S. Cl. ..... 273/197 A; 273/186 R; 273/200 B

[58] Field of Search ..... 273/186 R, 184 B, 185 D, 273/200 B, 197 R, 197 A

[56] References Cited

U.S. PATENT DOCUMENTS 4,526,373 7/1985 Medlock ..... 273/186 R

FOREIGN PATENT DOCUMENTS 2151144 7/1985 United Kingdom ..... 273/184 B

*Primary Examiner*—George J. Marlo

*Attorney, Agent, or Firm*—Samuelson & Jacob

[57] ABSTRACT

A golf practice device has a rotor with three simulated golf ball targets spaced equidistant from one another around the rotor, each target having mutually perpendicular webs and flanges forming a lightweight yet rugged construction readily molded in a unitary structure of synthetic resin material, and a housing within which the rotor is mounted for rotation about a horizontal axis and for ready removal and replacement. A plurality of telltales on the housing indicate any deviation from a true path by the head of a golf club swung at a target.

13 Claims, 4 Drawing Figures

GOLF PRACTICE DEVICE

The present invention relates generally to devices designed to promote the development of skills in playing games and pertains, more specifically, to a golf practice device which enables a golfer to practice swinging a golf club and hitting a golf ball.

An increasing number of people are taking up leisure time activities in the form of various games. One of the more popular games is the game of golf which offers a combination of skill and exercise suitable for both men and women of almost any age. One drawback of golf is that it requires extensive facilities for playing the game. Since these facilities are not always available readily to everyone wishing to develop skills in golfing at all times when a practice session may be desired, a variety of golf practice devices has been offered to enable practice and the development of golfing skills to be accomplished almost anywhere at anytime.

Among the many golf practice devices available to golfers are those which employ a golf ball, or a simulated golf ball, tethered in one way or another so as to enable the ball to be struck with a golf club, in much the same manner as in a golf game, yet remain with the practice device so that a golf swing and hitting of a golf ball may be practiced, even in a relatively confined space.

It is an object of the invention to provide a golf practice device which enables a golfer to simulate hitting a golf ball with a full swing of the golfer's own golf club, and to do so in a confined space.

Another object of the invention is to provide a golf practice device which aids in the correction of a faulty golf swing and enables the development of skill in striking golf balls.

Still another object of the invention is to provide a golf practice device which is simple in construction and is easily installed and used with minimum space requirements.

Yet another object of the invention is to provide a golf practice device of the type described and which is relatively inexpensive to manufacture and is easy to maintain at minimum expense.

A further object of the invention is to provide a golf practice device of the type described and which offers a realistic simulation of a golf ball as a target, and in which the simulated golf ball target is replaced readily and inexpensively when worn or damaged.

A still further object of the invention is to provide a golf practice device of the type described and which is inexpensive to purchase and easily installed without special tools or special skills.

The above objects, as well as still further objects and advantages, are attained by the present invention which may be described briefly as a golf practice device for enabling practice in striking a golf ball with the head of a golf club, when the golf ball is at a prescribed location relative to a ground surface, the golf practice device comprising: a rotor having three simulated golf ball targets spaced equidistant from one another about a horizontal axis of rotation; and mounting means for mounting the rotor relative to the ground surface for rotation relative to a predetermined ground surface level such that each target is movable through a striking position located above the ground surface level and corresponding to the prescribed location; the equidistant spacing of the targets assuring that at least one of the targets is accessible above the ground surface level when the rotor is at rest at any angular orientation about the horizontal axis of rotation for ease of placement of a target at the striking position and, upon striking the one of the targets at the striking position, the head of the golf club will follow through without interference from the next subsequent target.

The invention will be understood more fully, while still further objects and advantages will become apparent, in the following detailed description of a preferred embodiment of the invention illustrated in the accompanying drawing, in which.

Figure 1:
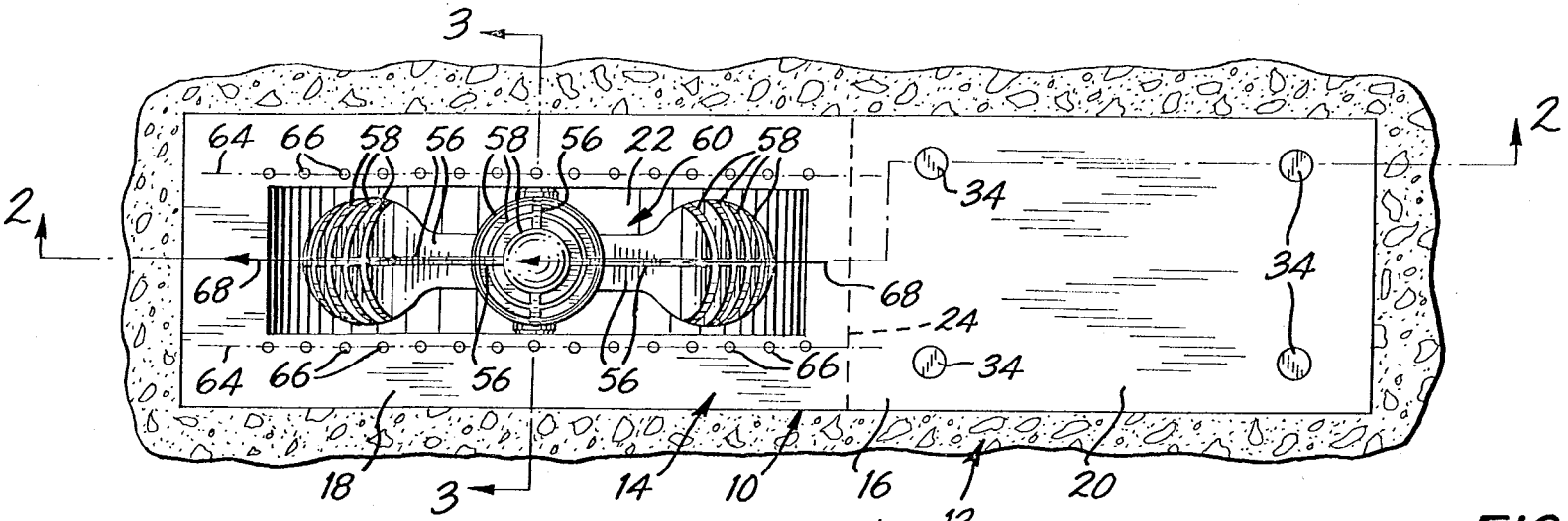
FIG. 1 is a top plan view of a golf practice device constructed in accordance with the invention, and installed at a practice site.
Figure 2:
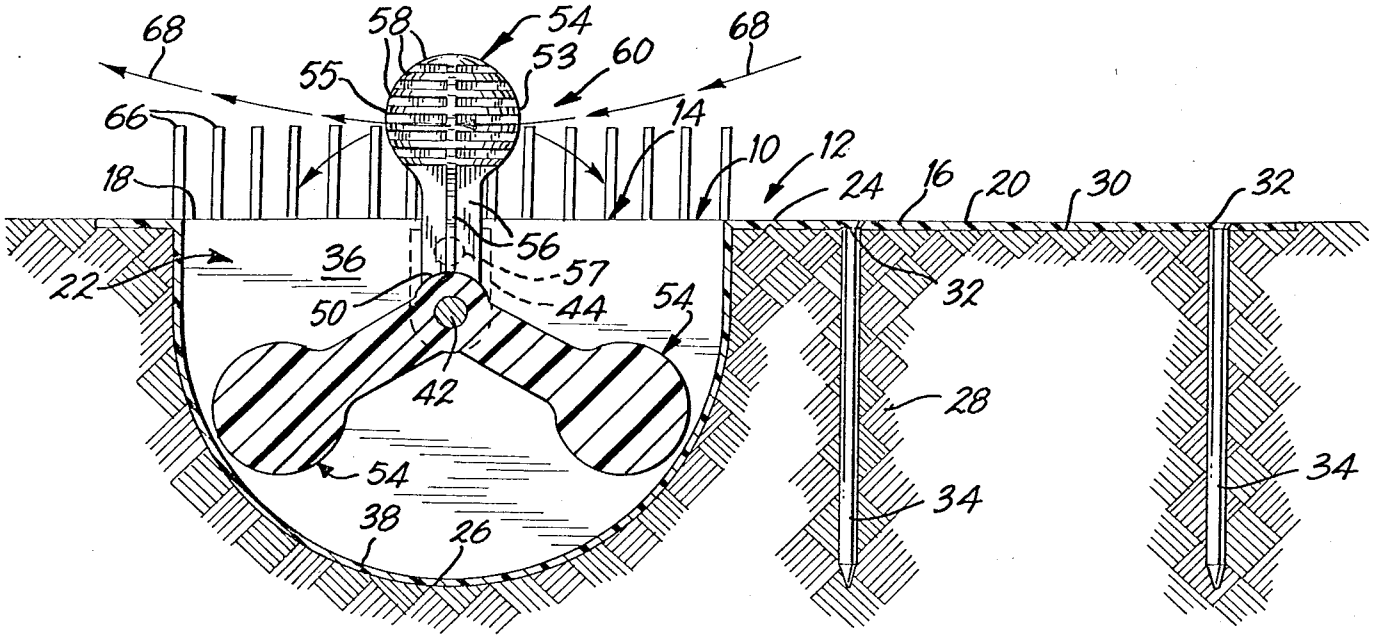
FIG. 2 is an elevational cross-sectional view taken along line 2—2 of FIG. 1.

Referring now to the drawing, and especially to FIGS. 1 and 2 thereof, a golf practice device 10 is constructed in accordance with the invention and is installed at a golf practice site 12. Practice device 10 has a housing 14 which includes a base plate 16 having a longitudinally forward portion 18 and a longitudinally rearward portion 20. A cup 22 depends from the forward portion 18 and a hinge 24 extends laterally across base plate 16 between the forward and rearward portions 18 and 20, for purposes which will be explained in detail below.

Site 12 may be located in a yard, a driveway or any relatively open patch of ground where a golfer can swing a golf club, but need not be located in a space any greater than that required for a full swing of the club. Golf practice device 10 is installed by digging out a small trench 26 in the ground 28 at the site 12 and then placing the housing 14 such that the base plate 16 is flush with the surface 30 of the ground 28, and the cup 22 enters the trench 26, as shown. A plurality of holes 32 in the rearward portion 20 enable headed spikes 34 to be passed through base plate 16 and driven into the ground 28 to secure the housing 14 in place at site 12.

Figure 3:
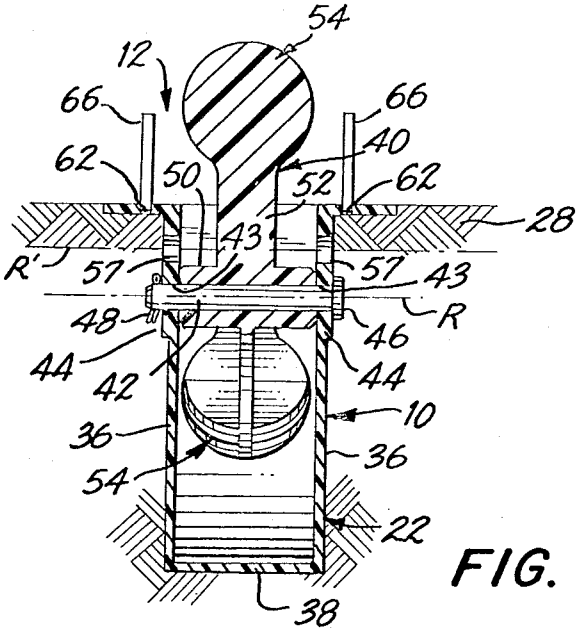
FIG. 3 is an elevational cross-sectional view taken along line 3—3 of FIG. 1.

As best seen in FIG. 3, as well as in FIGS. 1 and 2, cup 22 has depending side walls 36 and a bottom wall 38. A rotor 40 is mounted for rotation within cup 22 about a laterally extending, horizontal axis of rotation R. An axle 42 passes through apertures 43 in bosses 44 on side walls 36 and has a retaining head 46 at one end and a selectively removable retaining pin 48 at the other end so as to retain the axle 42 in place between side walls 36 along axis of rotation R. Rotor 40 has a hub 50 journaled for rotation on axle 42 and carries three arms 52 extending radially from hub 50 and spaced circumferentially equidistant from one another. Each arm 52 terminates in a simulated golf ball target 54 having an overall size and shape corresponding to a standard golf ball. The length of each arm 52 and the location of axis of rotation R relative to base plate 16 enables each target 54 to be placed selectively in a striking position, as illustrated in FIGS. 1 through 3, for striking by a golf club. Once in position, a target 54 may be addressed by a golfer, in the same manner as an actual golf ball, and struck, either on face 53 or face 55 of the target 54, by a golf club. The target 54 is driven in a direction which will cause the rotor 40 to rotate about axis of rotation R.

As shown in FIGS. 1 through 3, axle 42 is located in apertures 43 which constitute a lower set of apertures for defining a lower axis of rotation R and placing each target 54 selectively at a striking position relative to the surface 30 of ground 28 which corresponds to a fairway lie. An upper set of apertures is provided by apertures 57 in bosses 44, apertures 57 being placed immediately above apertures 43 in order to provide an alternate axis of rotation R' and an alternate striking position corresponding to a teed-up location of an actual golf ball. Thus, upon selective removal and replacement of axle 42 and rotor 40, targets 54 may be positioned to simulate either a fairway lie or a teed-up location.

The provision of three targets 54 spaced equidistant from one another, i.e., at 120 degrees from one another, assures that once having struck a target 54, the head of a golf club will be able to follow through to complete a full golf swing without interference from the next target 54 on the rotor 40. At the same time, the spacing of the targets 54 assures that at least one target 54 always is accessible above the surface 30 of ground 28, regardless of the orientation of rotor 40, so that a target 54 always is available for placement in the striking position with ease. In other words, regardless of the angular orientation of the rotor 40 about axis of rotation R when the rotor comes to rest, a target 54 will be located above base plate 16 and above surface 30 of ground 2 so that all the golfer need do is reach down with a golf club to engage the exposed target 54 and index the rotor 40 until a target 54 is placed in the desired position. No auxiliary locating mechanisms are required in order to effect proper location of a target 54 for striking, with ease.

The construction of the rotor 40, in general, and the targets 54, in particular, is such that golf practice device 10 provides a realistic "feel" while at the same time being economical. Thus, each arm 52 includes webs 56 which extend radially along arms 52 and preferably are perpendicular to one another, and which provide the appropriate combination of strength and flexibility with light weight to establish the appropriate inertial effect upon the striking of a target 54. The targets 54 themselves are light in weight, yet possess sufficient strength by the provision of flanges 58 which are spaced radially along the webs 56 of arms 52 at the radially outer extremities of the arms and extend between the webs 56, preferably such that the flanges 58 and the webs 56 are mutually perpendicular. The webs 56 have a profile contour at the outer extremities thereof simulating a golf ball configuration, and the flanges 58 likewise have a golf ball-simulating profile contour so that the web-and-flange construction of targets 54 provides a target having the overall dimensions and profile configuration simulating a standard golf ball, yet preserves the light weight necessary for the appropriate inertial properties in the rotor 40. At the same time, the targets 54 are strong enough to withstand the impact of a swinging golf club.

Figure 4:
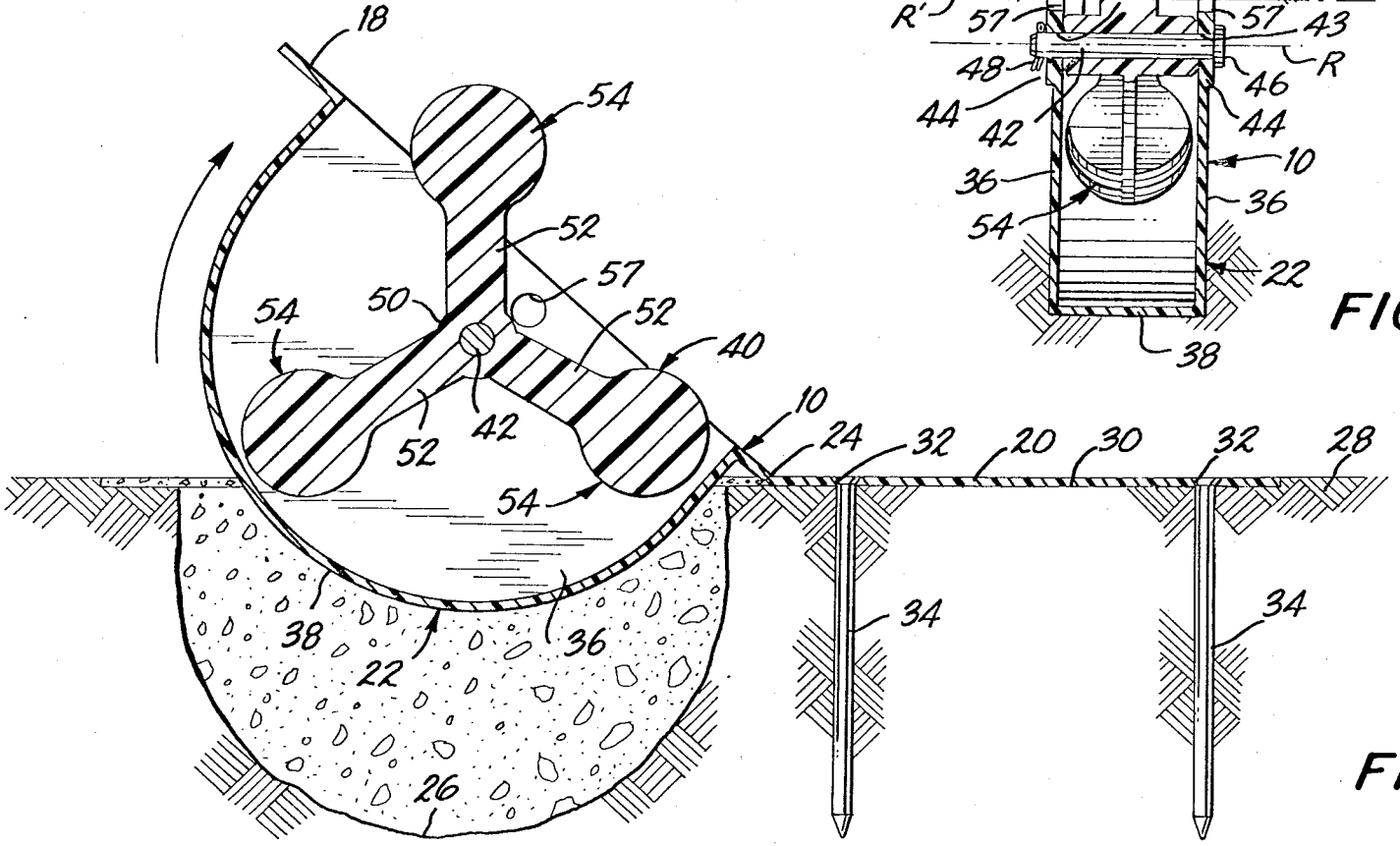
FIG. 4 is a view similar to FIG. 2, but with the component parts in another position.

Rotor 40 may be constructed of an impact-resistant synthetic resin material, such as a high-density polyethylene or polypropylene, and preferably is molded in a unitary structure. Likewise, housing 14 is economically manufactured by molding the housing 14 in one piece of synthetic resin material. When it is desired to remove rotor 40 from housing 14, either for repositioning, reversal or for replacement, the forward portion 18 of housing 14 merely is pivoted about hinge 24, as illustrated in FIG. 4, so that cup 22 is lifted out of trench 26 to expose the ends of axle 42 for removal of retaining pin 48 and withdrawal of axle 42 from hub 50 of rotor 40, to release rotor 40. Rotor 40 may then be reversed so as to reverse the positions of faces 53 and 55 and present unmarred faces after some use of rotor 40. Alternately, rotor 40 may be replaced entirely, the economical construction of the rotor rendering such replacement practical. In addition, rotor 40 may be repositioned, selectively, between axis of rotation R and axis of rotation R'. Where housing 14 is molded in one piece, hinge 24 is in the form of a plastic hinge unitary with the molded construction. The ability to swing cup 22 upwardly, as illustrated in FIG. 4, enables the user to clear unwanted foreign objects and matter from the interior of the cup 22 for safety purposes.

Returning now to FIGS. 1, 2 and 3, golf practice device 10 is equipped with means to mark the path of travel of a golf club head through the target area 60 during a practice swing, thereby providing the golfer with an indication of the accuracy of the swing. Thus, the forward portion 18 of base plate 16 includes a plurality of sockets 62 placed along a line 64 at either side of the cup 22, and the path of travel of targets 54. Each of the sockets 62 receives a telltale in the form of a rod 66 of wood, plastic, metal or any material which will either bend permanently or break upon being contacted by the club head as the golf club is swung at a target 54. If the club head follows a true and accurate path 68 across the target area 60, the club head will pass between lines 64 without making contact with any of the rods 66. However, any deviation from the true path 68 will cause at least some of the rods 66 to bend or break, providing the golfer with an indication of the deviation from the true path 68. Rods 66 preferably are constructed of expandable materials, such as match sticks or toothpicks, and easily are replaced by merely withdrawing the expended rods 66 from sockets 62 and replacing the withdrawn rods.

It will be apparent that golf practice device 10 provides a simple and economical means for developing the coordination and power necessary for a good golf swing. It encourages good habits and the attainment of accuracy. The golfer may practice full golf swings within the confines of his own back yard, or any other convenient location.

It is to be understood that the above detailed description of a preferred embodiment of the invention is provided by way of example only. Various details of design and construction may be modified without departing from the true spirit and scope of the invention as set forth in the appended claims.

The embodiments of the invention in which an exclusive property or privilege is claimed are defined as follows:

1. A golf practice device for enabling practice in striking a golf ball with the head of a golf club, when the golf ball is at a prescribed location relative to ground surface, said golf practice device comprising:

a rotor having three simulated golf ball targets spaced equidistant from one another about a horizontal axis of rotation; and mounting means for mounting the rotor relative to the ground surface for rotation relative to a predetermined ground surface level such that each target is movable through a striking position located above said ground surface level and corresponding to said prescribed location;

the rotor including a hub and three arms, each arm corresponding to one of said golf ball targets and carrying the corresponding target at the radially outer extremity of the arm, at least one of the targets including a web extending radially along the arm and having a radially outermost portion including a golf ball-like profile configuration at the outer extremity, and a plurality of flanges extending transverse to the web and spaced radially along the outermost portion of the web, each flange having a golf ball-like profile configuration such that the combined web and flanges present a simulated golf ball configuration at the outer extremity;

the equidistant spacing of the targets assuring that at least one of the targets is accessible above the ground surface level when the rotor is at rest at any angular orientation about the horizontal axis of rotation for ease of placement of a target at the striking position and upon striking said one of the targets at the striking position, the head of the golf club will follow through without interference from the next subsequent target.

2. The invention of claim 1 wherein the prescribed location is either one of a fairway lie and a teed-up location and the mounting means includes selective means for selecting a mounting position of the rotor and a striking position corresponding to either one of said fairway lie and said teed-up location.

3. The invention of claim 1 wherein the mounting means includes a housing having:

a base plate for resting upon the ground surface, the base plate including a first portion and a second portion;

depending walls extending downwardly from the first portion of the base plate;

journal means on the depending walls for journaling the rotor for rotation relative to the walls and the base plate, said journal means mounting the rotor for selective removal from the walls; and a hinge on the base plate between the first and second portions thereof for enabling selective swinging of the first portion relative to the second portion to raise the axis of rotation above the ground surface level and gain access to the journal means for selective removal of the rotor form the depending walls and the housing.

4. The invention of claim 3 wherein the prescribed location is either one of a fairway lie and a teed-up location and the journal means includes selective means for journaling the rotor at either one of two selected positions relative to the base plate, said two selected positions corresponding to said fairway lie and said teed-up location.

5. The invention of claim 3 wherein the base plate is a unitary member of synthetic resin material and the hinge is a plastic hinge unitary with the first and second portions of the base plate.

6. The invention of claim 3 including securing means in the second portion of the base plate for securing the base plate to the ground surface.

7. The invention of claim 6 wherein the securing means includes holes in the second portion of the base plate for receiving spikes to be driven through the holes and into the ground beneath the ground surface.

8. The invention of claim 1 wherein the one target includes a further web generally perpendicular to the first said web, and the flanges extend generally perpendicular to the first said web and the further web.

9. The invention of claim 8 wherein each one of all three of said targets includes the first said web, the further web and the plurality of flanges.

10. The invention of claim 9 wherein the rotor is a unitary member of synthetic resin material.

11. In a golf practice device for enabling practice in striking a golf ball with the head of a golf club, when the golf ball is at a prescribed location relative to a ground surface, the improvement comprising:

a rotor having at least one simulated golf ball target and capable of being mounted for rotation relative to a predetermined ground surface level such that the target is movable through a striking position located above said ground surface level and corresponding to said prescribed location, the rotor including a hub and an arm extending radially from the hub and corresponding to the target, the arm carrying the target at the radially outer extremity of the arm, the target including a web extending radially along the arm and having a radially outermost portion including a golf ball-like profile configuration at the outer extremity, and a plurality of flanges extending transverse to the web and spaced radially along the outermost portion of the web, each flange having a golf ball-like profile configuration such that the combined web and flanges present a simulated golf ball configuration at the outer extremity.

12. The invention of claim 11 wherein the target includes a further web generally perpendicular to the first said web, and the flanges extend generally perpendicular to the first said web and the further web.

13. The invention of claim 12 wherein the rotor includes a plurality of arms and a corresponding plurality of targets, each target including the first said web, the further web and the plurality of flanges.

* * * * *